United States Patent [19]

Björk et al.

[11] 4,230,040

[45] Oct. 28, 1980

[54] RELEASING DEVICE

[75] Inventors: Jan Björk, Bjärred; Jan T. Olsson, Landskrona; Bo S. Lindgren, Sandviken; Arne G. Borg; Jan A. R. Andersson, both of Lund, all of Sweden

[73] Assignee: SAB Industri AB, Malmo, Sweden

[21] Appl. No.: 949,988

[22] Filed: Oct. 10, 1978

[30] Foreign Application Priority Data

Oct. 10, 1977 [SE] Sweden ..... 7711322

[51] Int. Cl.[3] ..... F42B 22/16

[52] U.S. Cl. ..... 102/13

[58] Field of Search ..... 102/13

[56] References Cited

U.S. PATENT DOCUMENTS

| | | | |
|---|---|---|---|
| 1,294,327 | 2/1919 | Boston et al. | 102/13 |
| 2,413,450 | 12/1946 | Johnsen | 102/13 |
| 2,929,324 | 3/1960 | Berman et al. | 102/13 |
| 2,961,957 | 11/1960 | Wolf | 102/13 |
| 3,319,595 | 5/1967 | Van Dorn et al. | 102/13 |

*Primary Examiner*—Charles T. Jordan

*Attorney, Agent, or Firm*—Laurence R. Brown

[57] ABSTRACT

A releasing device for disconnecting a buoyant body from an anchor a predetermined period after having been sunk into water.

In order to accomplish a reliable device, which may be stored for very long periods of time, a piston is movable in a cylinder under the influence of a spring and a water pressure differential. The piston controls the disconnection of the buoyant body and the anchor, as the cylinder is connected to one part and the piston will release an element connected to the other part in a disconnecting position under the influence of the spring.

4 Claims, 5 Drawing Figures

RELEASING DEVICE

This invention relates to a releasing device of the type which is used for disconnecting a buoyant body from an anchor a predetermined period after the body tied to the anchor over said device having been sunk into water.

More particularly, the invention relates to a releasing device for disconnecting a mine from its anchor.

Mines which shall be anchored at a predetermined depth can be planted in the following manner: The mine which has a buoyancy providing a force in the order of for example 1,000 to 2,000 N is dropped into the sea tied to a mine anchor, the weight of which in water is substantially twice the buoyancy of the mine. The unit comprising the mine and the anchor tied to each other sinks to the bottom of the sea and usually is allowed to remain intact there for a period of five to ten minutes. Then, the mine is released and rises towards the surface pulling out an anchoring rope from a rope magazine on the anchor. When the mine has reached a preset depth, a pressure sensing mechanism interrupts further extension of the rope.

Usually, the mine is supported by a cradle on the anchor and is tied to the cradle at one end by means of a tie rod comprising two separate parts interconnected by a releasing device which comprises a body of a suitable salt having good compression strength. This salt body is dissolved in the water after a predetermined period, which can vary in a non-permissable way depending on various factors. When the body is dissolved, the mine will be released from the cradle at said one end. Pivoting at a connection between the mine and the cradle at the other end thereof the mine will slip off said latter connection and thus will be free to rise in the water. These prior art releasing devices including a salt body do not, however, satisfy present demands for operative reliability and extended storage life. The salt bodies are very hygroscopic, and considering that it may be desired to store them for a period as long as thirty years, considerable storage problems are involved.

A primary object of the invention is to provide a releasing device of the type referred to, especially for mines, which operates according to a more attractive principle and can be stored for a very long time, several decades, without being affected by surrounding conditions.

Another object of the invention is to provide a releasing device of the type referred to which requires no maintenance during storage.

A further object of the invention is to provide a releasing device of the type referred to which provides an extremely high operative reliability as regards i.a. to the time.

A still further object of the invention is to provide a releasing device of the type referred to which can be given small dimensions and is of a simple, sturdy construction and which can be produced under acceptable conditions and at a low cost.

To achieve the foregoing objects and in accordance with the present invention a releasing device of the type referred to above is characterized by a cylinder and a piston reciprocable therein, passages connecting cylinder spaces on opposite sides of the piston with the surroundings, the passage on the side of the piston having a considerably smaller area than that on the other side of the piston, spring means biasing the piston towards the cylinder space on said other side of the piston, latching means arresting the piston against the spring bias and adapted to be disengaged by movement of the piston against the spring bias, connecting means for the body and the anchor, respectively, at opposite ends of the cylinder, and means controlled by the piston to disconnect the cylinder at one of said connecting means in a position of the piston displaced towards the cylinder space at said other side thereof.

The invention will be described in further detail below, reference being made to the accompanying drawings, in which FIG. 1 is a fragmentary side view of a mine and the anchor associated therewith at one end of the mine where the mine is tied to the anchor over the releasing device;

Figure 1:
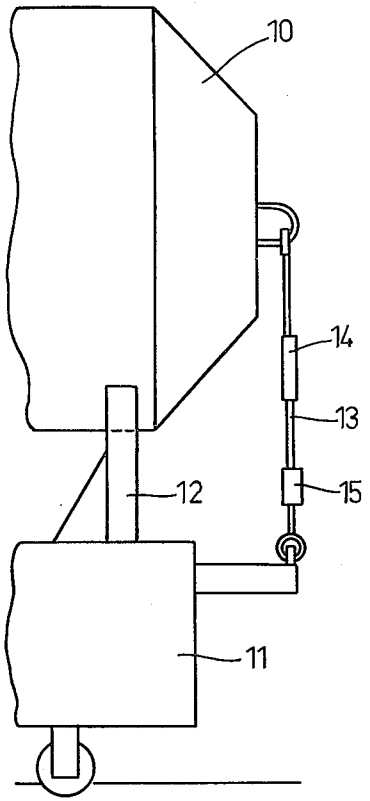

Referring to FIG. 1 of the drawings, there is shown a mine 10 which is tied at each end thereof to a wheeled anchor 11 the mine being supported at each end by a cradle 12 on the anchor. The connection at the end shown comprises a tie rod 13 having a turnbuckle 14 and a releasing device 15 according to the invention. The connection at the other end of the mine can be of the known type allowing the mine to slip off when released at the tie rod 13.

The releasing device 15 disengages the tie rod 13 a predetermined period after the unit including the mine and the anchor has been dropped into the sea so that the mine due to its buoyancy will rise initially at the end shown in FIG. 1 pivoting in the connection at the other end, and then will slip off the connection at said other end. When the untied mine rises towards the surface of the sea it pulls out a rope from the anchor and at a preset depth of the mine the extension of this rope from the anchor will be interrupted by a pressure sensitive mechanism in order to maintain the mine at the preset depth below the surface of the sea. This operation of the unit is well-known in the art.

Figure 2:
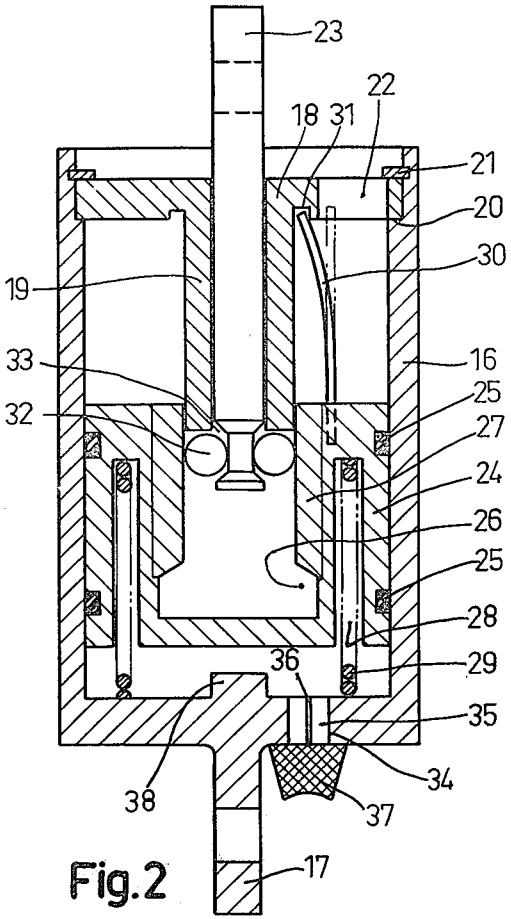
FIG. 2 is an enlarged vertical sectional view of the releasing device in one embodiment thereof.

Referring to FIG. 2, there is shown therein a first embodiment of the releasing device according to the invention. This releasing device includes a cylinder 16 provided with a fixed end wall at one end. At this end there is a lug 17 for connecting the cylinder to the anchor 11. The other end of the cylinder is closed by a separate end wall 18 with a guide socket 19 projecting into the cylinder. The end wall 18 is retained in the cylinder against an inside shoulder 20 by means of a resilient lock ring 21. In the end wall 18 there is provided a passage 22 having a wide cross sectional area, and in the socket 19 there is displaceably received a rod 23 which is intended to be connected with the mine 10.

A piston 24 is reciprocable in the cylinder and is provided with O-rings 25 sealingly engaging the inside surface of the cylinder. A central bore 26 in the piston 24 is provided with a bushing 27 which slideably receives the socket 19, and in an annular cavity 28 coaxially surrounding the bore 26 there is received a helical pressure spring 29. The spring biases the piston 24 towards the upper end of the cylinder the piston being disengageably retained in the position shown under the bias of the spring by means of a spring blade 30 one end of which is received in an annular groove 31 surrounding the socket 19 on the inner side of the wall 18. In this position the spring blade is slightly curved. The spring blade is located close to the passage 22 so that it can spring back to the straight position indicated by dot and dash lines in FIG. 2, if the piston 24 is pressed down slightly against the biasing force of the spring 29. In the straight position, the spring blade 30 can move through the passage 22 if and when the piston 24 moves upwards. Thus, it will be seen that the piston 24 is retained by the spring blade 30 in the position shown but will be disengaged for movement towards the upper end of the cylinder under the bias of the spring 29, if the piston initially is pushed down against the bias of the spring and then is relieved.

The bushing 27 in the bore 26 forms a flared lower end spaced from the bottom of the bore. Balls 32, preferably two or more, received by an annular groove 33 at the inner end of the rod 23 contact the inside surface of the bushing when received in the groove. When the piston 24 is in the position shown the rod 23 cannot be withdrawn from the socket 19 if the balls 32 bear against the inner end of the socket as they do when the tie rod 13 is tightened between the mine and the anchor at the turnbuckle 14. This condition will be maintained when the piston moves upwards until the balls 32 leave the bushing 27 at the lower end thereof and are received by the wider space formed by the bore 26 at the bottom thereof, where the balls can move out of the annular groove 33 and the rod 23 thus will be released for movement out of the socket 19.

At the lower end of the cylinder 16 there is provided a passage 34 fitted with a nozzle 35 forming a narrow passage 36 which connects the cylinder space at the lower side of the piston 24 with the surroundings, a filter 37 being provided over the passage 36. In the cylinder space at the lower side of the piston 24 there is formed on the end wall a central projection 38 which provides an abutment for the piston, defining the lower end position thereof.

In FIG. 2 the releasing device described is shown in stand-by condition, i.e. the condition in which the lug 17 and the rod 23 are interconnected to form part of the connecting tie rod 13 between the mine 10 and the anchor 11. The piston 24 is displaced towards the lower end of the cylinder 16 and spring 29 being compressed between the piston and the lower end wall of the cylinder, and the piston is held in this position by the spring blade 30 engaged between the piston and the upper end wall 18. It is noted that the piston 24 is spaced from the abutment 38.

When the unit comprising the mine 10 and the anchor 11 tied together has been dropped into the sea and sinks towards the bottom, the pressure on the upper side of the piston will increase as the pressure of the surrounding water increases with increasing depth of the sinking unit. Initially, the cylinder space at the lower side of the piston is filled with air, but when the unit is in the sea, water will be pressed into said space through the nozzle 35. However, the pressure in this space of the cylinder will increase very slowly due to the fact that the supply of water to the space is restricted by the narrow passage 36 of the nozzle 35, and thus there will be developed a pressure difference over the opposite sides of the piston 24 as illustrated by the diagrams in FIGS. 4 and 5.

Figure 4:
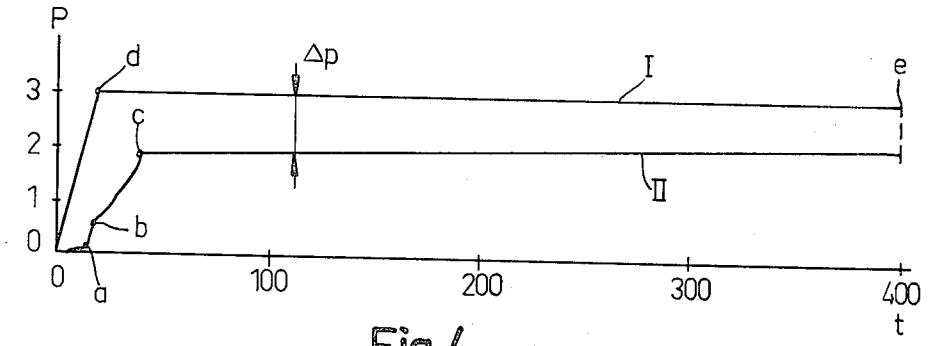
FIGS. 4 and 5 are diagrams showing the pressure on both sides of the piston over the time at a depth of 30 meters and 200 meters, respectively.
Figure 5:
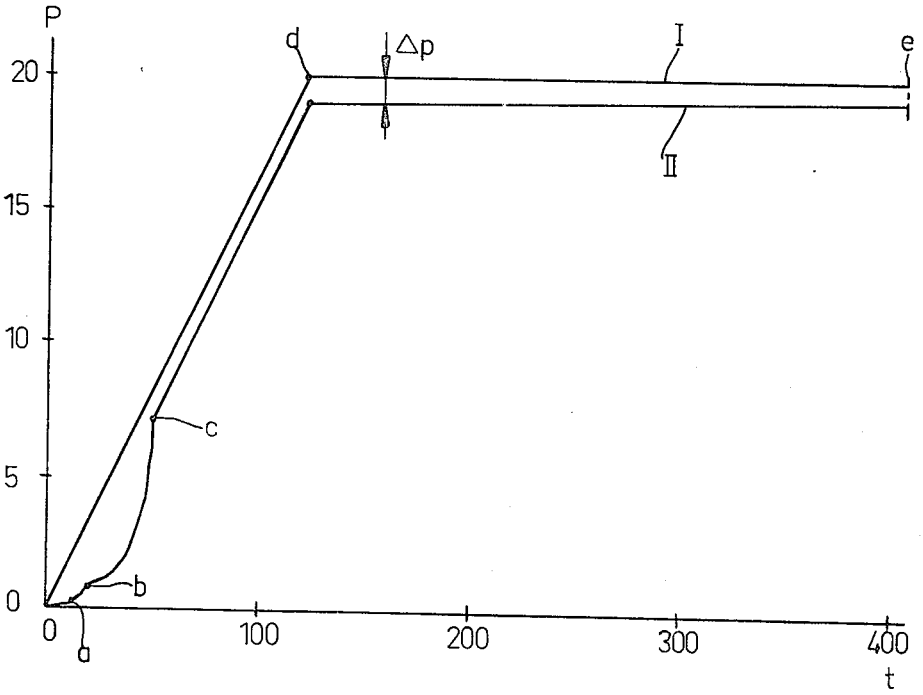

In FIGS. 4 and 5 the vertical axis indicates over-pressure in Bar and the horizontal axis indicates the time in seconds. The curve I represents the pressure in the cylinder space at the upper side of the piston 24 (identical with the surrounding water pressure) and the curve II indicates the pressure in the cylinder space at the lower side of the piston when the unit mine/anchor is sinking from the surface of the sea to a depth of 30 meters and 200 meters, respectively.

As shown in the diagrams of FIGS. 4 and 5, the pressure at the upper side of the piston increases rapidly at a constant speed corresponding to the sinking speed of the anchor/mine unit, until said unit reaches the bottom, indicated by a point d of curve I. At the same time the pressure at the lower side of the piston increases slowly. At point a of curve II the pressure difference over the piston is sufficient to overcome the resistance against displacement of the piston 24 downwards, provided by the bias of the spring 29 and the friction at the sealing rings 25 and the balls 32, so that the piston will be displaced downwards some millimeters to a lower end position in which the piston engages the abutment 38. Point b of curve II in the diagram has now been reached. By the displacement of the piston downwards the spring blade 30 will be disengaged from end wall 18 and will spring back to the straight position indicated by dot and dash lines in FIG. 2, which means that there is no obstruction for the piston to move in an upward direction.

When the piston is in the lower end position thereof, the pressure in the cylinder space at the lower side of the piston will continue to increase to a point c. At this point the bias of the spring 29 can overcome the pressure difference over the piston, indicated $\Delta p$, as well as the friction at the sealing rings 25 and the balls 32. Therefore, the piston will start to move slowly upwards, the spring blade 30 passing unobstructedly through the passage 22. During this movement the pressure difference $\Delta p$ is dependent of the spring bias and the friction only. However, as the spring bias decreases during the displacement of the piston the pressure difference $\Delta p$ will decrease slightly, as illustrated by the diagram. As will be understood, the same pressure difference $\Delta p$ is maintained also over the nozzle 35, which means that the flow rate through the passage 36 thereof will be independent of the operating depth of the releasing device.

When the piston 24 has moved to an upper position, wherein the balls 32 are received at the wide bottom space in the bore 26, the rod 23 will be released from the piston and thus the tie rod 13 will be disengaged in the manner initially described in order to release the mine 10 from the anchor 11. This corresponds to point e.

If the stroke volume, i.e. the volume represented by the movement of the piston 24 from the lower end position thereof to the upper position wherein the balls 32 disengage the rod 23, is made large in relation to the initial volume of the cylinder space at the lower side of the piston, there will be obtained a pressure difference $\Delta p$ which is dependent only of the spring bias and the friction during the major part of the time from planting the mine to the mine being released. Considering that the motion of the piston is thus independent of the depth during said major part of the time, disregarding a very slight variation due to the fact that the air volume confined in the cylinder space at the lower side of the piston will be compressed differently at varying depths, the releasing device is substantially independent of the depth at which the device is desired to operate.

As will be understood, the releasing device can be adapted to release the mine after a desired period by proper dimensioning of the spring 29 and the nozzle 35.

Figure 3:
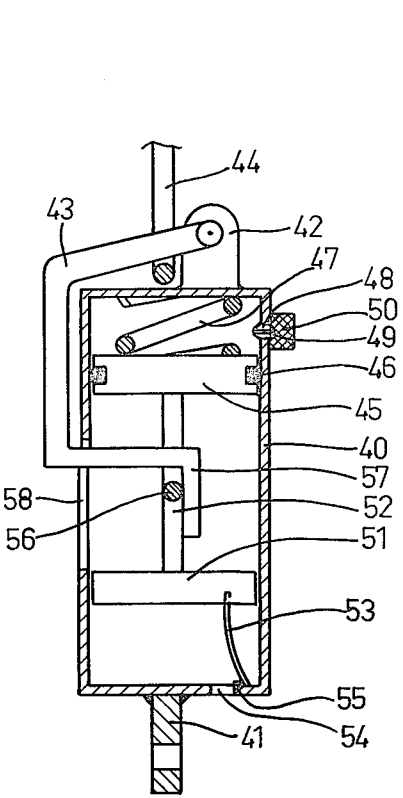
FIG. 3 is a vertical sectional view of the releasing device in another embodiment thereof.

In the embodiment shown in FIG. 3, which is simpler than that described above with reference to FIG. 2, there is provided a cylinder 40 closed at both ends, which has a lug 41 for connection with the anchor at one end thereof and a lug 42 for pivotal connection of a slip hook 43 at the other end thereof. The slip hook is engaged with an eye 44 forming part of the tie rod 13, FIG. 1, connected to the mine.

In the cylinder 40 there is displaceably mounted a piston 45 having an O-ring 46 for sealingly engaging the inside surface of the cylinder. A helical pressure spring 47 is mounted between the upper end of the cylinder and the piston, and the cylinder space at the upper side of the piston is connected to the surroundings through a restriction nozzle 48 having a passage 49 and a filter 50 which can be of the same type as that in FIG. 2.

The piston 45 forms part of a dumb-bell slide including a further piston 51 and a shaft 52 interconnecting the pistons 45 and 51. The piston 45 is the operative element of the releasing device which corresponds to the piston 24 in the embodiment shown in FIG. 2. The piston 51 is not sealed against the inside surface of the cylinder 40. In this latter piston there is mounted a spring blade 53 which engages the lower end wall of the cylinder under the bias of the spring 47 in a manner analogue to that described with reference to the spring blade 30 in FIG. 2. An opening 54 is provided in the lower end wall of the cylinder, and a projection 55 is provided at the opening to maintain the spring blade 53 in the engaged position slightly curved as shown in the drawing. If the slide is displaced upwards against the bias of the spring 47, the spring blade 53 can spring back to substantially straight condition so that it can pass through the opening 54.

On the shaft 52 there is provided a cross pin 56 which is engaged by the slip hook 43 at a part 57 thereof which extends along the shaft 52, when the dumb-bell slide is in the arrested position according to FIG. 3, the slip hook extending into the interior of the cylinder 40 through a wide opening 58 in the side wall thereof. However, during operation of the releasing device in the manner described above, said slide will be displaced upwardly to initially disengage the spring blade 53 so that the slide can then move downwards under the pressure difference over the piston 45. When this happens, the pin 56 will eventually slide off the portion 57 of the slip hook 43 so that the slip hook will be disengaged from the pin at the portion 57 and will be pivoted in a clockwise direction on the lug 42 due to the force exerted thereon by the buoyancy of the mine over the eye 44. Then, the mine will be released from the anchor in the manner described above.

The embodiment described with reference to FIG. 3 is believed to be the preferred embodiment of the releasing device according to the invention because the construction thereof is simple and reliable.

Further modifications would be possible within the scope of the claims.

We claim:

1. A releasing device used for disconnecting a buoyant body from an anchor a predetermined period after the body tied to the anchor by said device has been sunk into water comprising in combination, a cylinder and a piston reciprocably movable therein forming first and second cylinder spaces on opposite sides of the piston, each of said spaces being connected to the surroundings by respective first and second passages, the first passage having a considerably smaller cross-sectional area than the second passage, spring means biasing the piston for movement toward the second space, latching means arresting movement of the piston toward the second space and disengagable by movement of the piston against the spring bias, connecting means connecting the body and the anchor respectively at opposite ends of the cylinder, and first means for disconnecting one of the body and the anchor from the cylinder at the respective one of said connecting means when the piston is displaced towards the second space.

2. The releasing device of claim 1 wherein the spring means comprises a pressure spring mounted in the first space.

3. The releasing device of claim 2 wherein one of said connecting means comprises a member which is one of displaceably and pivotably mounted to the cylinder, and said first means comprises means locking said member against movement relative to the cylinder.

4. The releasing device of any of claims 1, 2 and 3 wherein said latching means comprises a spring blade engaging the piston and an abutment in the cylinder and deformed against the inherent resiliency of the blade, and an aperture for receiving the blade in an undeformed condition when disengaged from one of said piston and an abutment during displacement of the piston towards said second cylinder space.

* * * * *